US012247359B2

(12) United States Patent
Wang et al.

(10) Patent No.: US 12,247,359 B2
(45) Date of Patent: Mar. 11, 2025

(54) ROAD NETWORK BALANCED DRAINAGE METHOD AIMED AT REDUCING URBAN WATERLOGGING

(71) Applicants: QINGDAO UNIVERSITY OF TECHNOLOGY, Qingdao (CN); QINGDAO DONGHUIQUAN TECHNOLOGY CO. LTD., Qingdao (CN)

(72) Inventors: Jungang Wang, Qingdao (CN); Lu Wang, Qingdao (CN); Miaomiao Chen, Dezhou (CN); Hui Jiang, Qingdao (CN); Chong Li, Qingdao (CN); Naiyou Liu, Jiaozhou (CN); Dawu Nian, Dxing'anling (CN); Feida Chen, Qingdao (CN); Yifan Li, Tangshan (CN); Renyu Xu, Dezhou (CN); Xuefeng Zhang, Rongcheng (CN); Chaoyang Wang, Heze (CN); Xin Yao, Beijing (CN)

(73) Assignees: QINGDAO UNIVERSITY OF TECHNOLOGY, Shandong (CN); QINGDAO DOGHUIQUAN TECHNOLOGY CO. LTD., Shandong (CN)

( * ) Notice: Subject to any disclaimer, the term of this patent is extended or adjusted under 35 U.S.C. 154(b) by 817 days.

(21) Appl. No.: 17/602,662

(22) PCT Filed: Jun. 16, 2020

(86) PCT No.: PCT/CN2020/096308

§ 371 (c)(1),
(2) Date: Oct. 8, 2021

(87) PCT Pub. No.: WO2021/179465

PCT Pub. Date: Sep. 16, 2021

(65) Prior Publication Data

US 2022/0178086 A1 Jun. 9, 2022

(30) Foreign Application Priority Data

Mar. 8, 2020 (CN) ..... 202010154637.1

(51) Int. Cl.
*E01C 11/22* (2006.01)
*E01C 1/00* (2006.01)

(52) U.S. Cl.
CPC ..... *E01C 11/224* (2013.01); *E01C 1/002* (2013.01)

(58) Field of Classification Search
CPC ..... E01C 1/002; E01C 11/224
(Continued)

(56) References Cited

U.S. PATENT DOCUMENTS 7,198,432 B2 * 4/2007 Chen ..... E03F 1/002 405/36
7,575,394 B2 * 8/2009 Shaw ..... E01C 11/229 404/75

(Continued)

FOREIGN PATENT DOCUMENTS

AU 2019202413 A1 * 1/2020 ..... E01C 11/22
CN 103207923 A 7/2013

(Continued)

OTHER PUBLICATIONS

Tian et al., Urban Planning and Design, Oct. 31, 1998, pp. 188-198.

(Continued)

*Primary Examiner* — Raymond W Addie
(74) *Attorney, Agent, or Firm* — SZDC Law PC

(57) ABSTRACT

A road network balanced drainage method aimed at reducing urban waterlogging is disclosed. According to the drainage demand, the existing intersection elevation is changed or the intersection elevation that meets the drainage requirement is designed and implemented in new construction so that the intersection drainage is distributed according to the desired (Continued)

proportion; the water flowing to the water accumulation position is transferred to reduce the waterlogging degree. Through the analysis of the depth of water accumulation in the whole road network, the method of water flow distribution at the intersection is used to make the precipitation flow evenly distributed in the whole road network. The method can be used for solving serious water accumulation of a certain road section, the balanced drainage of the whole road network, the technical transformation of existing intersections, and for the planned and designed roads. The method can effectively eliminate and prevent urban waterlogging.

7 Claims, 6 Drawing Sheets

(58) Field of Classification Search
USPC ..... 404/1–4, 72, 75
See application file for complete search history.

(56) References Cited

U.S. PATENT DOCUMENTS 8,162,563 B2 * 4/2012 Shaw ..... E01C 11/18 404/31
8,267,618 B2 * 9/2012 Chen ..... E01C 11/226 404/31
8,469,625 B2 * 6/2013 White ..... E01C 11/08 404/2
9,540,776 B2 * 1/2017 von Langsdorff .... E01C 11/225
9,546,044 B2 * 1/2017 Boulton ..... E03B 11/14
2011/0110717 A1 5/2011 Eisenhardt
2011/0211908 A1 * 9/2011 Krzyzak ..... E01C 11/224 404/70
2013/0089372 A1 * 4/2013 Ciccarello ..... E01C 11/225 249/155
2013/0243525 A1 * 9/2013 White ..... E01F 5/00 404/2
2014/0270944 A1 * 9/2014 White ..... E01C 5/001 404/27
2023/0146557 A1 * 5/2023 Hester ..... E01C 11/005 404/2

FOREIGN PATENT DOCUMENTS

CN 104318793 A 1/2015
CN 109544912 A 3/2019
CN 109657841 A 4/2019
CN 109902864 A 6/2019

OTHER PUBLICATIONS

Zeng, Research on Urban Vertical Planning Based on Drainage Prevention Safety, Constant Development, Rational Planning, Chinese City Planning Annual Meeting Papers (01 City Safety and Disaster Prevention), pp. 29-37, Nov. 18, 2017.

* cited by examiner

ROAD NETWORK BALANCED DRAINAGE METHOD AIMED AT REDUCING URBAN WATERLOGGING

This application is the National Stage Application of PCT/CN2020/096308, filed on Jun. 16, 2020, which claims priority to Chinese Patent Application No. 202010154637.1, filed on Mar. 8, 2020, which is incorporated by reference for all purposes as if fully set forth herein.

TECHNICAL FIELD

The present invention relates to the technical field of urban drainage design, in particular to a road network balanced drainage method aimed at reducing urban waterlogging and a road construction method based on the purpose of balanced road network drainage.

BACKGROUND

The standard of the rainfall return period of the urban drainage channels is usually 2-5 years, and rainfall exceeding this standard may cause urban waterlogging. At present, the main methods to solve urban waterlogging include deep drainage tunnels and LID (Low Impact Development). The investment and operation costs of the deep tunnel are huge, and there are also environmental risks; LID is a comprehensive measure, including various water retention schemes such as storage and infiltration, which can reduce or delay the rainfall entering the rainwater pipe network. LID is a popular research direction at present, but the amount of waterlogging that can be reduced is limited, which cannot solve the problem of waterlogging in heavy rainfall.

The main goal of elevation design at the intersection in the current road design is to meet the requirement of driving safety and comfort, rapid drainage, and architectural art. The requirements of elevation design at the intersection for drainage are limited to rapid drainage and no water accumulation. The design and acceptance of intersection elevation are basically in a macroscopic and fuzzy state. Urban roads have the characteristics of the open channel structure. When urban waterlogging occurs, the disaster degree is concerned, while the drainage function is ignored. The drainage of the urban road sections is linear, and the direction of the water flow may change after entering the intersection. The flow distribution ratio of each outflow intersection is different when multiple intersections flow out. The flow distribution depends on the elevation design (microgeomorphology) at the intersection, and this field is still a blank in research.

With the development of urban construction, the functions of urban roads are constantly improving, and the number of urban overpasses and underpasses is gradually increasing. Overpasses are mostly set on the main roads with frequent traffic. The lowest point forms a basin, and the longitudinal slope is large. Therefore, rainwater quickly accumulates at the lowest point of overpasses, which easily causes waterlogging.

SUMMARY OF THE INVENTION

The present invention aims to solve the above problems, and provides a road network balanced drainage method aimed at reducing urban waterlogging to solve the problem of urban road waterlogging.

A road network balanced drainage method aimed at reducing urban waterlogging, including:

Step 1: determining a water accumulation section; specifically: (1) determining the waterlogged road section through observation and analysis, or (2) through drawing analysis and on-site observation, the section with V-shaped longitudinal road surface alignment at the non-intersection is determined as the waterlogged road section. Determining waterlogged road sections through observation and analysis refers to determining the waterlogged road sections through consulting and analyzing historical records or direct observation during rainfall.

Step 2: taking the intersection at the upstream of the road section where the water accumulation section is located as the first intersection;

Step 3: judging if the requirement of flow distribution is met at the first intersection; the conditions for meeting the flow distribution requirement are: in addition to the road where water accumulation sections are located, one or more longitudinal slope roads are deviating from the intersection (i.e., the terrain of the intersection is high, and the farther away from the intersection, the lower the terrain is), and there is no water accumulation section on the longitudinal slope roads deviating from the intersection.

Step 4: carrying out elevation reconstruction at the first intersection if the requirement of flow distribution is met at the first intersection so that the water flowing into the first intersection flows to the road other than the road where the water accumulation section is located; if the requirement of flow distribution is not met at the first intersection, tracing along the water inlet road of the first intersection upwards to the second intersection at upstream side;

Step 5: judging if the requirement of flow distribution is met at the second intersection;

Step 6: carrying out elevation reconstruction at the second intersection if the requirement of flow distribution is met at the second intersection so that the water flowing into the second intersection flows towards the road outside of the first intersection; if the requirement of flow distribution is not met at the second intersection, tracing along the water inlet road of the second intersection upwards to the third intersection at upstream side;

Step 7: judging if the requirement of flow distribution is met at the third intersection;

Step 8: carrying out elevation reconstruction at the third intersection if the requirement of flow distribution is met at the third intersection so that the water flowing into the third intersection flows to the road outside of the second intersection; if the requirement of flow distribution is not met at the third intersection, tracing along the water inlet road of the third intersection upwards to the fourth intersection at upstream side;

By analogy.

On the basis of the above scheme, the elevation reconstruction is to change the height and slope of the road entering each intersection at the intersection.

On the basis of the above scheme, if the number of longitudinal slope roads that meet the requirement of flow distribution at the same intersection is greater than or equal to 2, the amount of water entering different longitudinal slope roads can be controlled through elevation reconstruction.

The above road network balanced drainage method aimed at reducing urban waterlogging is mainly for the reconstruction of existing roads. In addition to the above scheme, the idea of the present invention can be used in newly built roads. Therefore, for newly designed and built roads, the present invention provides a road construction method based on the purpose of the balanced road network drainage. When building a road intersecting with a road with water accumulation, the height and slope of the road at the intersection can be changed through elevation design to control the water flow to not flow or less flow to the road with water accumulation section.

On the basis of the above scheme, the roads with water accumulation sections are existing roads with waterlogged sections and water accumulation sections, existing roads with V-shaped longitudinal road surface alignment at non-intersections, or roads that are not built but have V-shaped longitudinal road surface alignment at non-intersections in the design.

On the basis of the above scheme, for the existing roads with waterlogged sections and water accumulation sections, and the existing roads with V-shaped longitudinal road surface alignment at the non-intersection, when building the intersecting roads, the newly built road will not drain towards the existing roads and/or the water originally flowing into the water accumulation section will flow to the newly built roads through elevation reconstruction at the intersection point.

On the basis of the above scheme, for the unbuilt roads that have V-shaped longitudinal road surface alignment at the non-intersection point in the design, when newly designing and building the intersecting roads, the newly designed and built road will not drain toward the unbuilt road that has V-shaped longitudinal road surface alignment at the non-intersection point in the design, and/or the water flowing into the low point of V-shaped will flow to the newly designed and built intersecting road through elevation reconstruction at the intersection point. The above V-shaped refers to a certain road section that presents a terrain high on both sides and low in the middle as a whole. During rainfall, rainwater flows from the high terrain to the low terrain in the middle, resulting in water accumulation in this road section, especially at the low point;

The present invention has the following advantages: changing the existing intersection elevation according to the drainage requirement or designing and implementing the intersection elevation that meets the drainage requirement in new construction so that the intersection drainage (water flowing out of the intersection) is distributed according to the desired proportion; the water flowing to the water accumulation position is transferred to reduce the waterlogging degree. Through the analysis of the depth of the water accumulation in the whole road network, the method of water flow distribution at the intersection is used to make the precipitation flow evenly distributed in the whole road network. For newly built roads, the method of the present invention can effectively prevent the occurrence of urban waterlogging and achieve the effect of planning ahead.

BRIEF DESCRIPTION OF THE DRAWINGS

In order to explain the embodiments of the present invention or the technical solutions in the prior art more clearly, the drawings used in the description of the embodiments, or the prior art will be briefly introduced in the following. Obviously, the drawings in the following description are only one embodiment of the present invention, and for those of ordinary skill in the art, the drawings of other implementations can be derived from the provided drawings without creative work.

Figure 1:
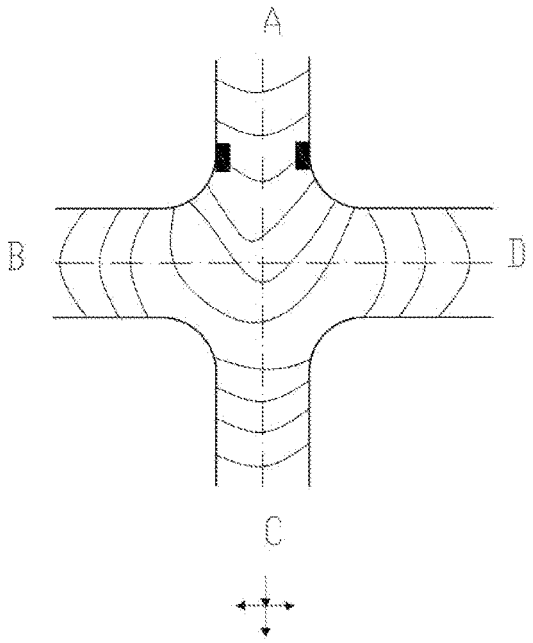
FIG. 1 is a schematic diagram of an intersection with one-way inlet and three-way outlets of mode 1 in embodiment 1 before reconstruction.

The thick solid line in the drawing is the lane edge, which defines the design scope of drainage; the thin solid curve is the contour line, which describes the three-dimensional coordinates of the road surface; the dotted line is the watershed, which is the characteristic line of the road surface topography; the arrow is the direction of water flow, and the single arrow inside of the intersection is the direction of the collection of water flow; the single arrow that leaves the intersection and points to the direction of the road section outside of the intersection is not only the water flow direction but also the blocked water flow direction of the intersection, that is, the direction of the water accumulation section; the direction of the double arrow that leaves the intersection and points to the road section outside of the intersection is the set flow direction. The small black filled square in the drawings is the rainwater inlet of the road drainage system, which is arranged at the rainwater inflow end of the intersection.

DESCRIPTION OF THE EMBODIMENTS

The present invention will be further explained with reference to the drawings and examples: Embodiments of the present invention are described in detail below, examples of the embodiments are shown in the accompanying drawings, in which identical or similar reference numerals denote identical or similar elements or elements having identical or similar functions throughout. The embodiments described below by referring to the drawings are exemplary and are only used to explain the present invention, and should not be understood as a limit of the present invention.

Embodiment 1

The embodiment provides a road network balanced drainage method aimed at reducing urban waterlogging, including:

Step 1: determining a water accumulation section; specifically: (1) determining the waterlogged road section through observation and analysis, or (2) through drawing analysis and on-site observation, the section with the V-shaped longitudinal road surface alignment at the non-intersection is determined as the water accumulation road section.

Step 2: taking the intersection at the upstream of the road section where the water accumulation section is located as the first intersection;

Step 3: judging if the requirement of flow distribution is met at the first intersection; the conditions for meeting the flow distribution requirements are: in addition to the road where the water accumulation sections are located, one or more longitudinal slope roads are deviating from the intersection (i.e., the terrain of the intersection is high, and the farther away from the intersection, the lower the terrain is), and there is no water accumulation section on the longitudinal slope roads deviating from the intersection.

Step 4: carrying out elevation reconstruction at the first intersection if the requirement of flow distribution is met at the first intersection so that the water flowing into the first intersection flows to the road other than the road where the water accumulation section is located; if the requirement of flow distribution is not met at the first intersection, tracing along the water inlet road of the first intersection upwards the second intersection at upstream side;

Step 5: judging if the requirement of flow distribution is met at the second intersection;

Step 6: carrying out elevation reconstruction at the second intersection if the requirement of flow distribution is met at the second intersection so that the water flowing into the second intersection flows to the road outside of the first intersection; if the requirement of flow distribution is not met at the second intersection, tracing along the water inlet road of the second intersection upwards the third intersection at upstream side;

Step 7: judging if the requirement of flow distribution is met at the third intersection;

Step 8: carrying out elevation reconstruction at the third intersection if the requirement of flow distribution is met at the third intersection so that the water flowing into the third intersection flows to the road outside of the second intersection; if the requirement of flow distribution is not met at the third intersection, tracing along the water inlet road of the third intersection upwards the fourth intersection at upstream side;

By analogy, judging if the requirement of flow distribution is met at the fourth intersection; if the requirement of flow distribution is met at the fourth intersection, carrying out elevation reconstruction at the fourth intersection so that the water flowing into the fourth intersection flows to the road outside of the third intersection; if the requirement of flow distribution is not met at the fourth intersection, tracing along the water inlet road of the fourth intersection upwards the fifth intersection at upstream side;

Preferably, if the number of the longitudinal slope roads that meet the requirement of flow distribution at the same intersection is greater than or equal to 2, the amount of water entering different longitudinal slope roads can be controlled through elevation reconstruction.

Design principle: take advantage of the characteristic of 'water flowing to the lower place', the intersection elevation is set into a landform with 'watershed' and 'gully'. The water flowing to the waterlogged road section is blocked by the 'watershed' ('watershed' ridge line), and the rainwater entering the intersection is introduced to the preset drainage road section along the 'gully' extending from the intersection to the road section. When the water depth in the intersection exceeds the watershed, the water flow entering the intersection begins to split towards the water accumulation road section. According to the different combinations of upstream and downstream intersections, the elevation diagram of the present invention can have various embodiments and is not limited to the listed diagrams. Factors such as driving comfort are the constraints of the elevation design.

Figure 2:
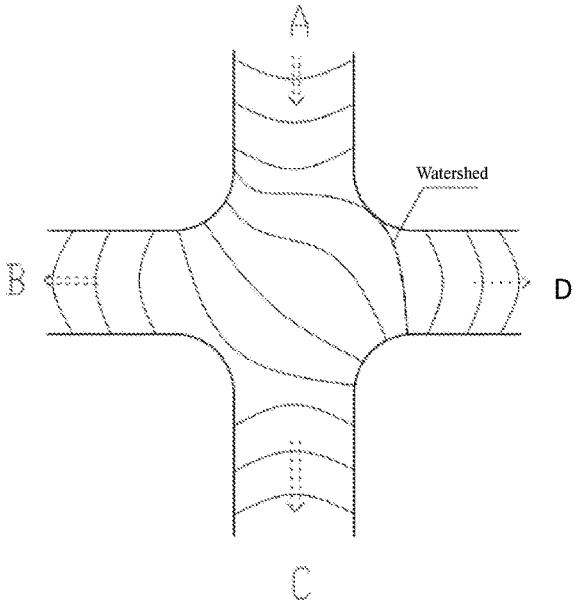
FIG. 2 is a schematic diagram of an intersection with one-way inlet and three-way outlets of mode 1 in embodiment 1 after reconstruction (road D has a water accumulation section)
Figure 3:
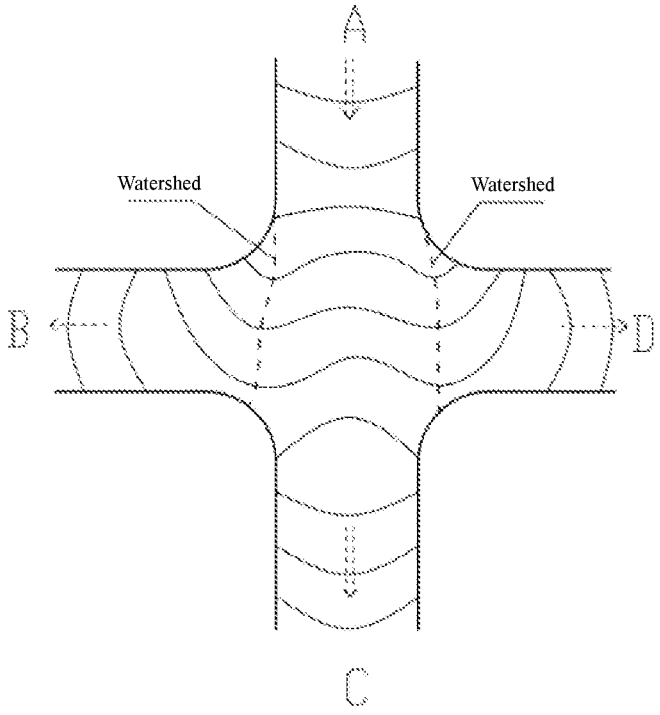
FIG. 3. is a schematic diagram of an intersection with one-way inlet and three-way outlets of mode 1 in embodiment 1 after reconstruction (both road B and road D have water accumulation sections)
Figure 4:
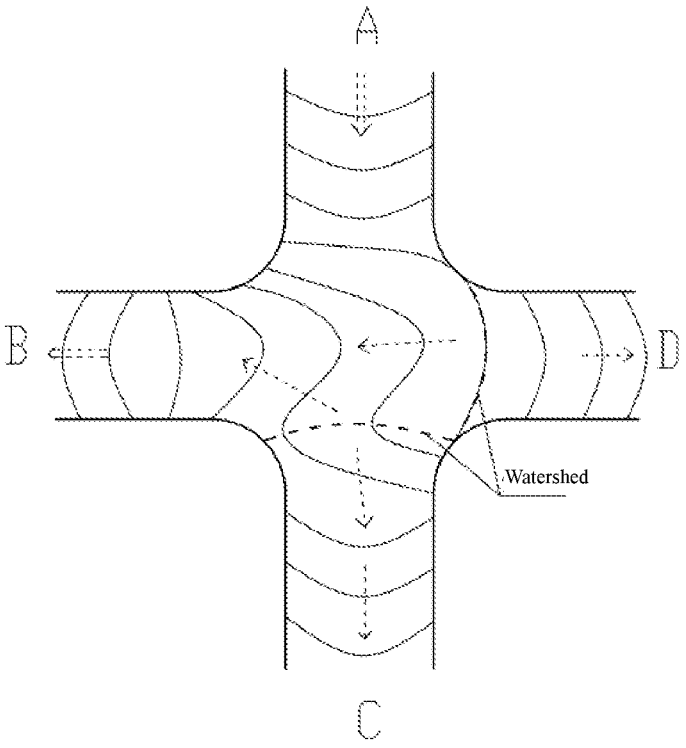
FIG. 4. is a schematic diagram of an intersection with one-way inlet and three-way outlets of mode 1 in embodiment 1 after reconstruction (both road C and road D have water accumulation sections)
Figure 5:
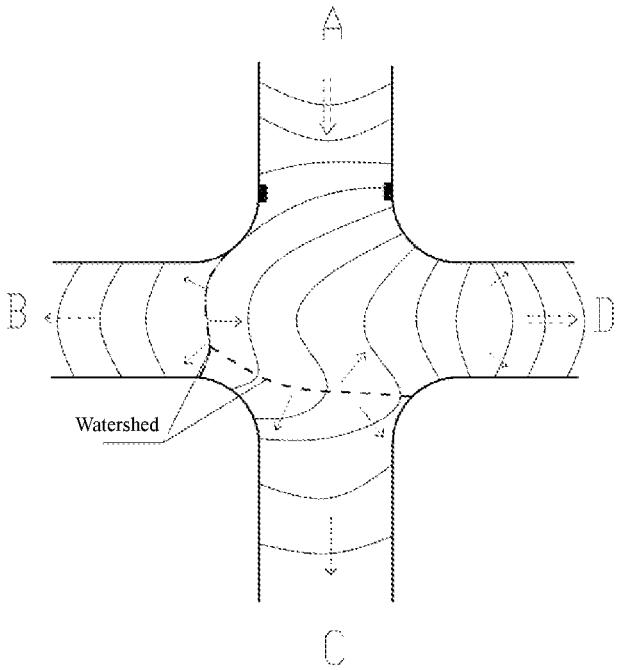
FIG. 5 is a schematic diagram of an intersection with one-way inlet and three-way outlets of mode 1 in embodiment 1 after reconstruction (both road B and road C have water accumulation sections)

Mode 1: FIG. 1 shows the intersection is in the one-way inlet and three-way outlets state; when it rains, rainwater flows into the intersection from road A and flows out from roads B, C, and D;

After observation and analysis, it is assumed that road D has a water accumulation road section while roads B and C don't have water accumulation road sections. As shown in FIG. 2, elevation reconstruction is carried out at the intersection to raise the terrain at one side of the road D of the intersection so that the large flow of rainwater flowing from road A flows out from roads B and C. Reducing or cutting off the amount of rainwater flowing into road D, so as to avoid or reduce the occurrence of waterlogging of road D; elevation reconstruction is to construct a road to be reconstructed according to the requirement of road construction, and watershed (watershed line) is formed on the road, which can make water flow in the pre-designed direction. After observation and analysis, it is assumed that both roads B and D have water accumulation road sections, while road C doesn't have a water accumulation road section. As shown in FIG. 3, elevation reconstruction is carried out at the intersection to raise the terrain at one side of the roads B and D of the intersection, and two watersheds are formed so that the large flow of rainwater flowing from road A flows out from road C. Reducing or cutting off the amount of rainwater flowing into roads B and D, so as to avoid or reduce the occurrence of waterlogging of roads B and D;

After observation and analysis, it is assumed that both roads C and D have water accumulation road sections, while road B doesn't have a water accumulation road section. As shown in FIG. 4, elevation reconstruction is carried out at the intersection to raise the terrain at one side of the roads C and D of the intersection, and two watersheds are formed so that the large flow of rainwater flowing from road A flows out from road B. Reducing or cutting off the amount of rainwater flowing into roads C and D, so as to avoid or reduce the occurrence of waterlogging of roads C and D;

After observation and analysis, it is assumed that roads B, C, and D have water accumulation road sections, the elevation reconstruction at the intersection will be given up, and trace upstream along road A to the previous intersection for judgement; or even if roads B, C and D all have water accumulation road sections, roads B and D are the most serious, or roads C and D are the most serious, or roads B and C are the most serious, in which case, the elevation drawings as shown in FIGS. 3, 4 and 5 can be used respectively. Through the elevation reconstruction, less rainwater will flow into the road section with the most serious waterlogging, and more rainwater will flow into the road sections with relatively little water accumulation so that the flow distribution will be more reasonable.

Figure 6:
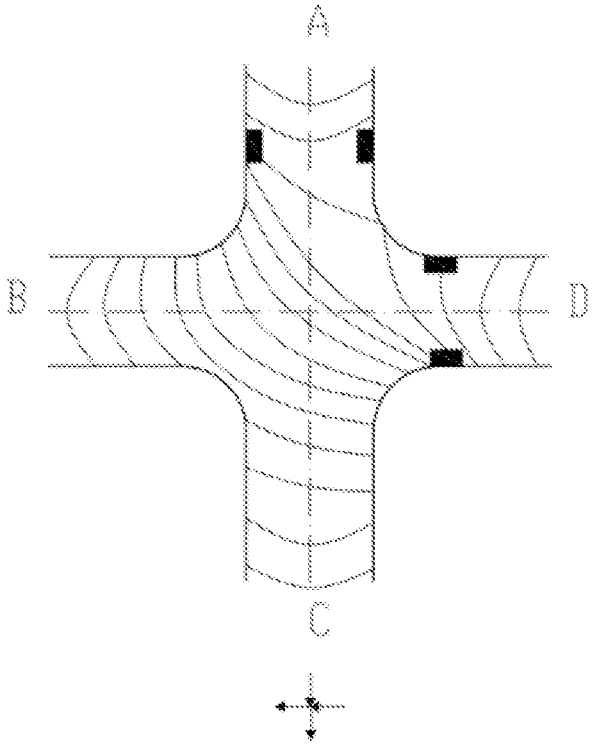
FIG. 6 is a schematic diagram of an intersection with single-slope two-way inlets and two-way outlets of mode 2 in embodiment 1 before reconstruction.
Figure 7:
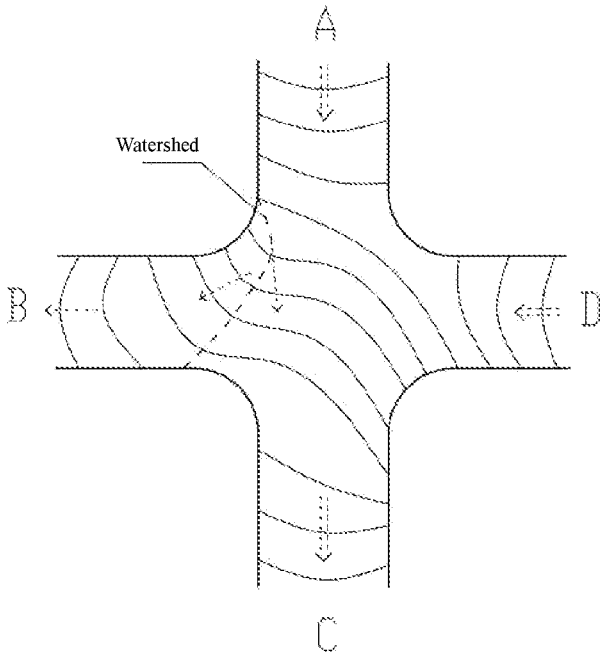
FIG. 7 is a schematic diagram of an intersection with single-slope two-way inlets and two-way outlets of mode 2 in embodiment 1 after reconstruction (road B has a water accumulation section)
Figure 8:
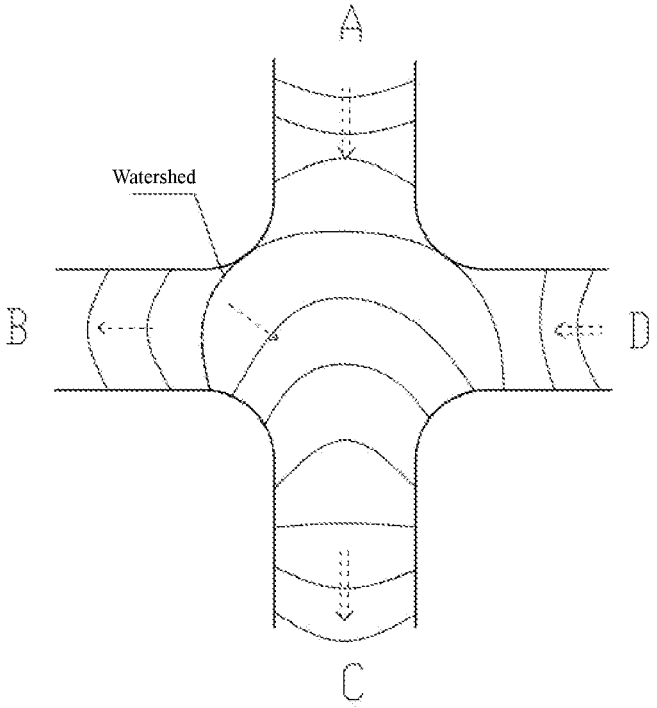
FIG. 8 is another schematic diagram of an intersection with single-slope two-way inlets and two-way outlets of mode 2 in embodiment 1 after reconstruction (road B has a water accumulation section).

Mode 2: FIG. 6 shows the intersection is in the single-slope two-way inlets and two-way outlets state. When it rains, rainwater flows into the intersection from A and D and flows out from B and D;

After observation and analysis, it is assumed that road B has a water accumulation road section, while road C doesn't have a water accumulation road section. As shown in FIGS. 7 and 8, elevation reconstruction is carried out at the intersection to raise the terrain at one side of the road B of the intersection, and a watershed is formed so that the large flow of rainwater flowing in will flow out from road C. Reducing or cutting off the amount of rainwater flowing into road B, so as to avoid or reduce the occurrence of waterlogging in road B; both FIG. 7 and FIG. 8 can achieve the function of preventing water flow, FIG. 7 is suitable for the situation that roads B and D have large slopes, and FIG. 8 is suitable for the situation that roads B and D have small slopes. According to the different conditions of roads, different forms of the watershed are formed through elevation reconstruction, but the goal is to raise the terrain at one side of road B at the intersection so that the large flow of rainwater flowing in will flow out from road C. Reducing or cutting off the amount of rainwater flowing into road B, so as to avoid or reduce the occurrence of waterlogging in road B.

After observation and analysis, it is assumed that both roads B and C have water accumulation road sections, the elevation reconstruction at the intersection will be given up, and trace upstream along roads A and D respectively to the previous intersection for judgement; or raise the terrain at one side of the roads B and C with the most serious waterlogging during reconstruction so that less rainwater will flow into the roads with the most serious waterlogging.

Figure 9:
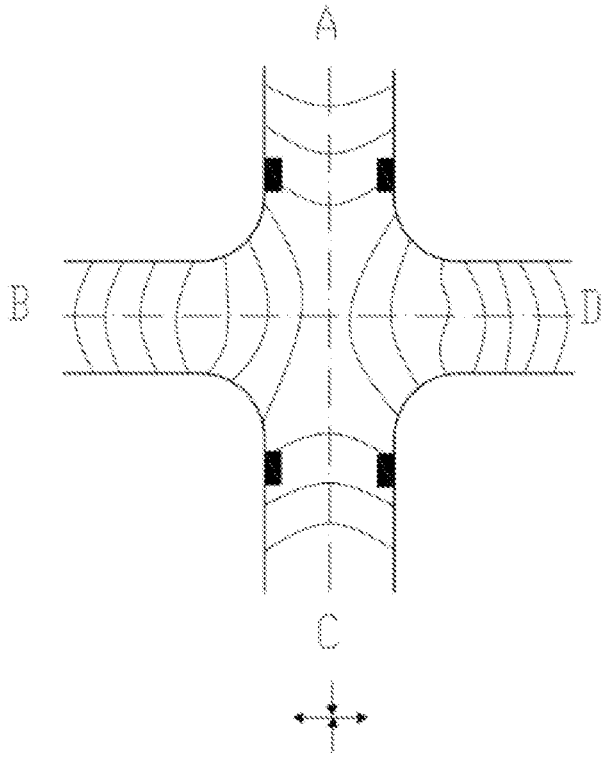
FIG. 9 is a schematic diagram of an intersection with saddle-shaped two-way inlets and two-way outlets of mode 3 in embodiment 1 before reconstruction.
Figure 10:
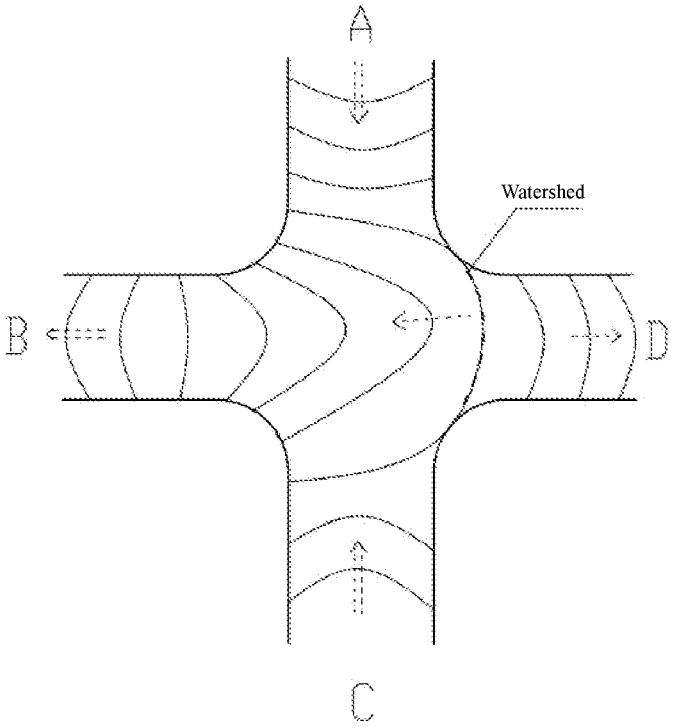
FIG. 10 is a schematic diagram of an intersection with saddle-shaped two-way inlets and two-way outlets of mode 3 in embodiment 1 before reconstruction (road D has a water accumulation section)

Mode 3: FIG. 9 shows the intersection is in the saddle-shaped two-way inlets and two-way outlets state. When it rains, rainwater flows into the intersection from A and C and flows out from B and D;

After observation and analysis, it is assumed that road D has a water accumulation road section, while road B doesn't have a water accumulation road section. As shown in FIG. 10, elevation reconstruction is carried out to raise the terrain at one side of the road D of the intersection, and a watershed is formed so that the large flow of rainwater flowing in will flow out from road B. Reducing or cutting off the amount of rainwater flowing into road D, so as to avoid or reduce the occurrence of waterlogging of road D;

After observation and analysis, it is assumed that both roads B and D have water accumulation road sections, the elevation reconstruction at the intersection will be given up, and trace upstream along road A and C respectively to the previous intersection for judgement; or raise the terrain at one side of the roads B and D with the most serious waterlogging during reconstruction so that less rainwater will flow into the road with the most serious waterlogging.

Figure 11:
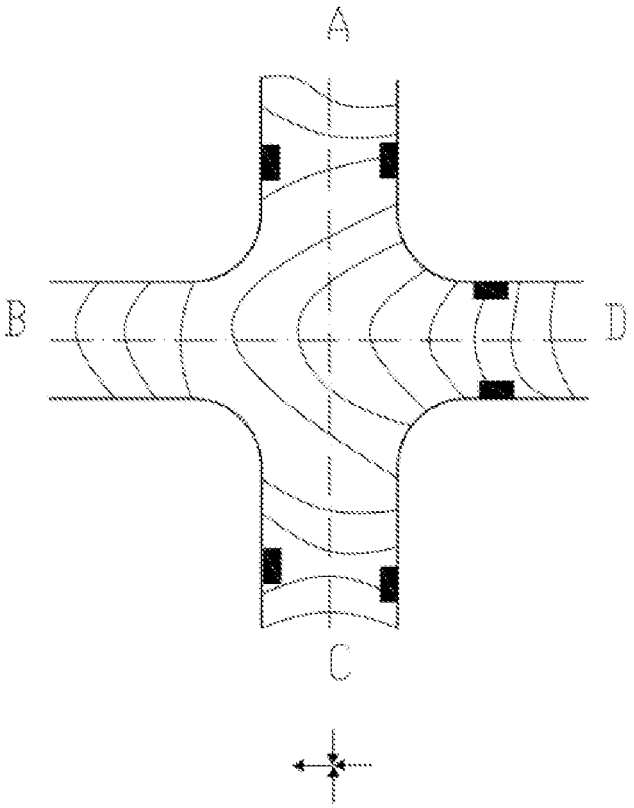
FIG. 11 is a schematic diagram of an intersection with multiple inlets and one-way outlet of mode 4 in embodiment 1 before reconstruction.

Mode 4: FIG. 11 shows the intersection is in the multiple inlets and one outlet state; when it rains, rainwater flows into the intersection from multiple inlets and flows out from one outlet; the elevation reconstruction will generally be given up for this type of intersection, and trace upstream along inlet roads respectively to the previous intersection for judgement and reconstruction. In extreme cases, the elevation design of one or more intersecting roads will be changed so that the inflow and outflow of intersections become more than one drainage section, which will be treated according to the above methods from mode 1 to mode 3.

Embodiment 2

A road construction method based on the purpose of balanced road network drainage is provided. When a road intersecting with a road with a water accumulation section is built, the geomorphic form of the intersection and its limited adjacent areas are changed through elevation design so that the water flow is controlled to not flow or flow less to the road with water accumulation section.

On the basis of the above scheme, the roads with water accumulation section are the existing roads with waterlogged sections and water accumulation sections, the roads with V-shaped longitudinal road surface alignment at the existing non-intersection, or the unconstructed roads with V-shaped longitudinal road surface alignment at the existing non-intersection in the design. On the basis of the above scheme, for the existing roads with waterlogged sections and water accumulation sections and the roads with V-shaped longitudinal road surface alignment at the existing non-intersection, when constructing the intersecting roads, the newly built roads will not drain towards the existing roads and/or the water flowing into the waterlogged sections will flow to the newly-built roads through elevation reconstruction at the intersection.

On the basis of the above scheme, for the unconstructed roads but with V-shaped longitudinal road surface alignment at the non-intersection in the design, when newly designing, building the intersecting roads, the newly designed and built road will not drain towards the unconstructed roads with V-shaped longitudinal road surface alignment at the non-intersection in the design and/or the water flowing into the V-shaped low point will flow to the newly designed and built intersecting roads through elevation reconstruction.

The present invention has been described by way of example above, but the present invention is not limited to the above specific embodiments, and any modification or variation based on the present invention all belong to the scope of the present invention.

The invention claimed is:

1. A road network balanced drainage method aimed at reducing urban waterlogging, comprising:

Step 1: determining a water accumulation section;

Step 2: taking the intersection at the upstream of the road section where the water accumulation section is located as the first intersection;

Step 3: judging if the requirement of flow distribution is met at the first intersection;

Step 4: carrying out elevation reconstruction at the first intersection if the requirement of flow distribution is met at the first intersection so that the water flowing into the first intersection flows to the road other than the road where the water accumulation section is located; if the requirement of flow distribution is not met at the first intersection, tracing along the water inlet road of the first intersection upwards to the second intersection at upstream side;

Step 5: judging if the requirement of flow distribution is met at the second intersection;

Step 6: carrying out elevation reconstruction at the second intersection if the requirement of flow distribution is met at the second intersection so that the water flowing into the second intersection flows towards the road outside of the first intersection; if the requirement of flow distribution is not met at the second intersection, tracing along the water inlet road of the second intersection upwards to the third intersection at upstream side;

Step 7: judging if the requirement of flow distribution is met at the third intersection;

Step 8: carrying out elevation reconstruction at the third intersection if the requirement of flow distribution is met at the third intersection so that the water flowing into the third intersection flows to the road outside of the second intersection; if the requirement of flow distribution is not met at the third intersection, tracing along the water inlet road of the third intersection upwards to the fourth intersection at upstream side; and repeating Step 1 to Step 8 until the intersection meeting the requirements of flow distribution is found and the facade renovation is carried out at the intersection, so that the flow of water into the intersection to flow to the road other than the upper intersection or to flow to the road other than the road where the water-logged section is located, wherein Step 1 is (1) determining the waterlogged road section through observation and analysis, or (2) through drawing analysis and on-site observation, the section with V-shaped longitudinal road surface alignment at the non-intersection is determined as the waterlogged road section.

2. The method according to claim 1, wherein the conditions for meeting the flow distribution requirement are: in addition to the road where water accumulation sections are located, one or more longitudinal slope roads are deviating from the intersection, and there is no water accumulation section on the longitudinal slope roads deviating from the intersection.

3. The method according to claim 2, wherein the elevation reconstruction is to change the topography of the intersection and its limited adjacent areas according to functional requirements, so that the water flow into the intersection flows to the road other than the upper intersection or to the road other than the road where the water-logged section is located.

4. The method according to claim 3, wherein if the number of longitudinal slope roads that meet the requirement of flow distribution at the same intersection is greater than or equal to 2, the amount of water entering different longitudinal slope roads can be controlled through elevation reconstruction.

5. A road construction method based on the purpose of the balanced road network drainage, comprising building a road intersecting with a road with water accumulation, the height and slope of the road at the intersection can be changed through elevation design to control the water flow to not flow or less flow to the road with water accumulation section, wherein the roads with water accumulation sections are existing roads with waterlogged sections and water accumulation sections, existing roads with V-shaped longitudinal road surface alignment at non-intersections, or roads that are not built but have V-shaped longitudinal road surface alignment at non-intersections in the design.

6. The method according to claim 5, wherein, for the existing roads with waterlogged sections and water accumulation sections, and the existing roads with V-shaped longitudinal road surface alignment at the non-intersection, when building the intersecting roads, the newly built road will not drain towards the existing roads and/or the water originally flowing into the water accumulation section will flow to the newly built roads through elevation reconstruction at the intersection point.

7. The method according to claim 5, wherein, for the unbuilt roads that have V-shaped longitudinal road surface alignment at the non-intersection point in the design, when newly designing and building the intersecting roads, the newly designed and built road will not drain toward the unbuilt road that has V-shaped longitudinal road surface alignment at the non-intersection point in the design, and/or the water flowing into the low point of V-shaped will flow to the newly designed and built intersecting road through elevation reconstruction at the intersection point.

* * * * *